United States Patent [19]

Benetti

[11] Patent Number: 4,932,143

[45] Date of Patent: Jun. 12, 1990

[54] SKI BOOT

[75] Inventor: Cristiano Benetti, Postioma, Italy

[73] Assignee: Lange International S.A., Fribourg, Switzerland

[21] Appl. No.: 399,867

[22] Filed: Aug. 29, 1989

[30] Foreign Application Priority Data

Oct. 10, 1988 [CH] Switzerland ..... 3773/88

[51] Int. Cl.[5] ..... A43B 5/04

[52] U.S. Cl. ..... 36/120; 36/117

[58] Field of Search ..... 36/117, 118, 119, 120, 36/121

[56] References Cited

U.S. PATENT DOCUMENTS

| | | | |
|---|---|---|---|
| 3,543,421 | 12/1970 | Ader | 36/121 |
| 3,969,833 | 7/1976 | Vaccori | 36/117 |
| 4,499,676 | 2/1985 | Chalmers, II | 36/117 X |
| 4,519,150 | 5/1985 | Arieh et al. | 36/121 |
| 4,575,958 | 3/1986 | Arieh et al. | 36/121 |
| 4,761,899 | 8/1988 | Marxer | 36/121 |
| 4,821,433 | 4/1989 | Marxer | 36/121 |

FOREIGN PATENT DOCUMENTS

| | | | |
|---|---|---|---|
| 0073433 | 3/1983 | European Pat. Off. | 36/117 |
| 0286586 | 10/1988 | European Pat. Off. | 36/117 |
| 3825271 | 2/1989 | Fed. Rep. of Germany | 36/117 |

*Primary Examiner*—Paul T. Sewell
*Assistant Examiner*—Andrew D. Meyers
*Attorney, Agent, or Firm*—Kane,Dalsimer,Sullivan,Kurucz,Levy,Eisele & Richard

[57] ABSTRACT

Ski boot comprising an articulated shank equipped with means of connection to the lower part, which means of connection make it possible to fix or release the shank for rotation, to regulate the inclination of the shank and the elasticity of an elastic element. The connection is supplied by a threaded bar (4) capable of being driven to rotate by a knurled wheel (14). The locking of the shank (5) in rotation is ensured by a lock (6). The elastic element is formed by a cylindrical sleeve (17) whose expansion is more or less inhibited by a sliding rigid sleeve (22).

3 Claims, 2 Drawing Sheets

SKI BOOT

FIELD OF THE INVENTION

The present invention relates to a ski boot comprising at least a lower part intended to surround the foot and the heel and a shank articulated on this lower part and comprising, at the rear, connecting means between the shank and the lower part, these connecting means comprising means for fixing or releasing the shank for rotation relative to the lower part, means for regulating the inclination of the shank relative to the lower part by a screw/nut system, at least one elastic element, and means for regulating the elasticity of this elastic element.

PRIOR ART

A boot provided with locking means for the shank which are capable of being unlocked in order to permit the pivoting of this shank, and means permitting the inclination of the shank in the locked position to be adjusted, is described in patent No. FR 2,491,304. The device used comprises a lever articulated at its end to a stirrup fixed to the inner part of the boot and at an intermediate point, by means of sliding nut carried by a threaded rod forming part of the lever, to the end of a connecting rod articulated to a stirrup fixed to the shank. The threaded rod is provided with gripping means enabling it to be rotated in order to displace the sliding nut. Consideration has been given to replacing the connecting rod with an adjustable elastic connection such as described in U.S. Pat. No. 3,619,914. The introduction of such an elastic mechanism would, however, substantially increase the bulk of the device. Moreover, in the walking position, when the shank pivots on the lower part of the boot, all the articulations are stressed and impede the movement of the shank.

A simple device using neither screw nor nut is known from Patent No. CH-549,970. This device comprises an elastic stirrup whose two angled arms engage in holes on either side of an element fixed to the lower part of the boot. When the lever is pushed downwards, the shank is released, but simultaneously the adjustment of the inclination of the shank is lost. Moreover, the connecting device possesses no elasticity.

A lockable and unlockable device having an elastic knee-joint is likewise known from Patent No. EP 0 248,149. This device does not make it possible to adjust the inclination of the shank.

The object of the present invention is to provide a compact device fulfilling the three abovementioned functions, namely locking and unlocking of the shank of the boot, adjustment of the inclination of the said shank and adjustment of the flexial strength of said shank. The device is not to comprise any articulation or lever projecting in the unlocked position and/or caused to pivot during walking.

SUMMARY OF THE INVENTION

The boot according to the invention is a boot wherein the connecting means comprise a bar extending parallel to the back of the shank, whose lower end, which is threaded, is screwed into a block and whose upper end bears against a first bearing of the shank, this bar being fitted with a means for driving it in rotation in order to regulate the inclination of the shank, the means for fixing or releasing the shank being formed by a lock mounted in said block whose tongue interacts with a seating provided in the lower part of the boot, the elastic element being formed by an elastic sleeve of non-compressible material freely surrounding said bar and being subjected to compression between a second bearing of the shank and a rigid cylinder fixed to said bar, the means for regulating the elasticity of said elastic sleeve being formed by a rigid sleeve surrounding the elastic sleeve and capable of being displaced along the elastic sleeve in a manner such as to modify the length of the elastic part situated outside the rigid sleeve and consequently capable of undergoing expansive deformation.

The connecting means according to the invention make it possible to achieve the three desired functions with very simple means.

BRIEF DESCRIPTION OF THE DRAWINGS

The attached drawing shows, by way of example, an embodiment of the invention.

DESCRIPTION OF THE PREFERRED EMBODIMENT(S)

Figure 1:
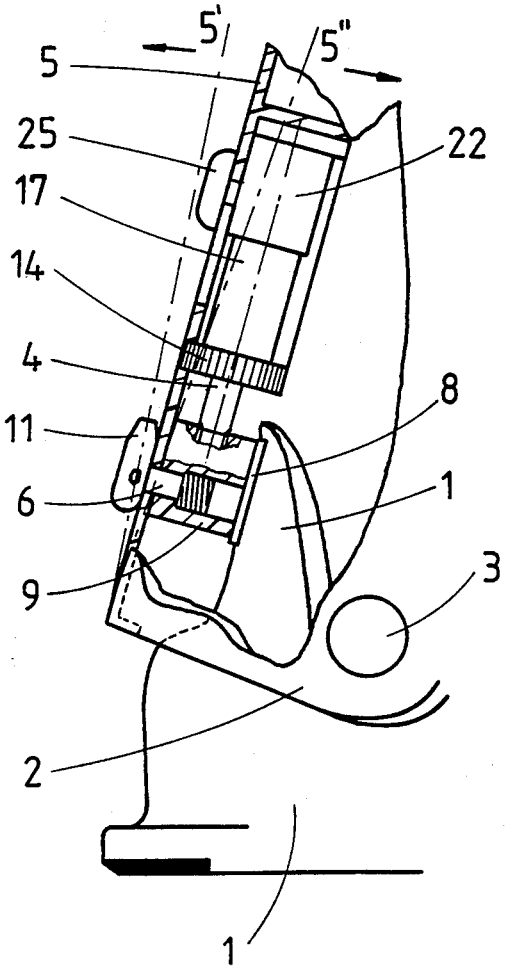
FIG. 1 shows a side view of the rear part of a ski boot in which part of the shank has been cut away to show the connecting means between the shank and the lower part of the boot.
Figure 2:
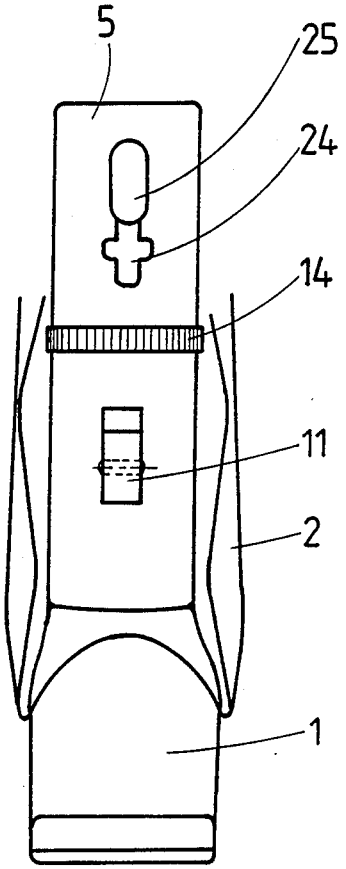
FIG. 2 is a rear view of the boot.
Figure 3:
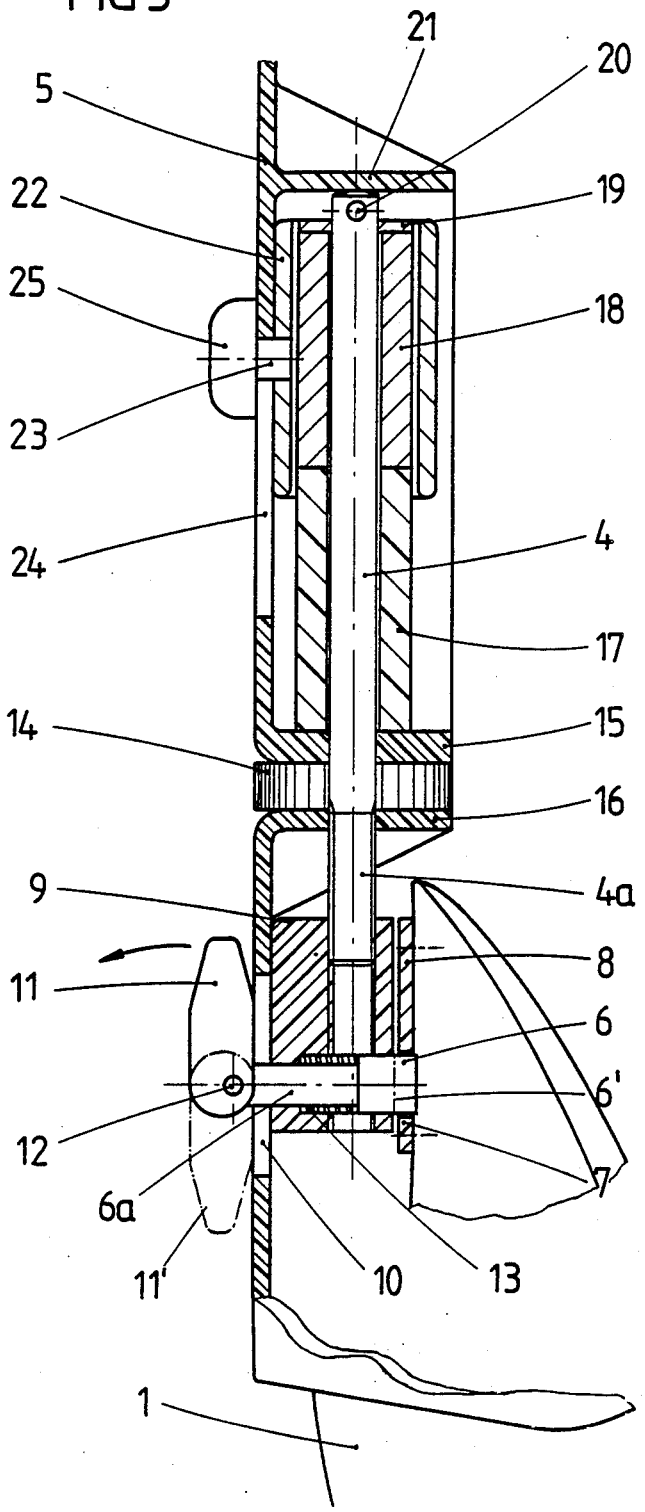
FIG. 3 is an enlargement of FIG. 1.

The boot partially shown in FIGS. 1 to 3 is a boot having a shell of synthetic material, of known design. It comprises a lower part or shell base 1 surrounding the foot and the heel and a shank or calf 2 articulated 3 on the lower part 1. The shank 2 can further be connected to the lower part 1 by connecting means essentially comprising a bar 4 extending in a vertical plane parallel to the rear 5 of the shank 2 and a cylindrical lock 6 interacting with a hole 7 in a small metal plate 8 fixed to the lower part 1 of the boot. The bar 4 possesses a lower threaded end **4*a* screwed into a metal block 9 in which the lock 6 is fitted. This lock 6 possesses an extension 6*a* of reduced diameter passing through the block 9 and projecting beyond the shank 1 of the boot through a slot 10. At the end of this extension 6*a* an eccentric operating lever 11 is articulated about an axis 12. The lock 6 is pushed towards the hole 7 by a spring 13 seated in the block 9**.

On the bar 4 is mounted a knurled wheel 14 which is fixed in rotation with the bar but can slide thereon. The knurled wheel 14 is mounted between two bearings 15 and 16 of the back 5 of the shank 1 of the boot in a manner such that it projects beyond this back of the shank just sufficiently to be actuated by means of the thumb.

The bar 4 further passes through a cylindrical rubber sleeve 17 together with a cylinder 18 of rigid metal or synthetic material, placed above the elastic sleeve 17 and retained by a washer 19 which is itself retained by a key 20 near the rounded end of the bar 4; this rounded end bears against a bearing 21 of the back of the shank 1. Around the cylinder 18, having the same diameter as the elastic sleeve 17, is fitted a rigid sliding sleeve 22 of metal or synthetic material which can likewise slide, with slight play, around the elastic sleeve 17. This sliding sleeve 22 is provided with a radial arm 23 passing through the back 5 of the shank, through a slot 24 parallel to the bar 4. The arm 23 is equipped with a drive button 25 by means of which the user can slide the sliding sleeve 22. In the position of the operating lever 11 shown in continuous lines, the lock 6 is engaged in the hole 7 and the shank 1 of the boot can therefore not pivot about its articulation 3. This is the descending position. When the operating lever 11 is swung downwards into the position 11' shown in broken lines, the lock 6 is disengaged from the hole 7 as shown at 6', and the shank 1 can then pivot freely about its articulation 3. This is the walking position or position of rest.

If the user wishes to modify the inclination of the shank 1, in the locked position of course, he needs only to rotate the knurled wheel 14, the effect of which is to tighten or loosen the bar 4 in the block 9, and consequently to lengthen or shorten the length L between the axis of the lock 6 and the upper end of the bar 4, that is to say the length of this 4. Since the upper end of the bar 4 determines the bearing point of the shank 1, if this bearing point is higher, for example, the shank 1 will have to incline towards the front of the boot. Sufficient play is provided between the lock 6 and the hole 7 to permit slight pivoting of the bar 4 relative to the position shown in FIG. 1, either forwards or backwards.

The forward flexial elasticity of the shank 1 is insured by the elastic sleeve 17, as described in U.S. Pat. No. EP 0 206 394. During forward flexion of the shank 1, the sleeve 17 is compressed between the bearing 15 of the shank and the cylinder 18. Under the action of this compression, the sleeve 17 undergoes radial expansion. By lowering the rigid outer sleeve 22 around the elastic sleeve 17, the part of this sleeve 17 surrounded by the rigid sleeve 22 is prevented from extending radially, and consequently the hardness of the elastic element is increased. When the elastic sleeve 17 is completely surrounded by the rigid sleeve 22, the connection between the shank 1 and the lower part of the boot is virtually rigid.

The connection between the shank and the lower part of the boot is, however, rigid in respect of the backwards pivoting of the shank. It would nevertheless be readily possible to introduce an elastic element either between the upper end of the bar 1 and stop 21 or between the block 9 and the lock 6.

The lock could be embodied in a different manner.

I claim:

1. Ski boot comprising at least a lower part (1) intended to surround the foot and the heel and a shank (2) articulated on this lower part and comprising, at the rear, connecting means between the shank and the lower part, these connecting means comprising means (6) for fixing or releasing the shank for rotation relative to the lower part, means (14) for regulating the inclination of the shank relative to the lower part by a screw/-nut system, at least one elastic element (17), and means for regulating the elasticity of this elastic element,.-wherein the connecting means comprise la bar (4) extending parallel to the back of the shank, whose lower end (**4*a*), which is threaded, is screwed into a block (9) and whose upper end bears against a first bearing (21) of the shank, this bar (4) being fitted with a means for driving it in rotation (14) in order to regulate the inclination of the shank, the means for fixing or releasing the shank being formed by a lock (6) mounted in said block whose tongue interacts with a seating (7) provided in the lower part of the boot, the elastic element being formed by an elastic sleeve (17) of non-compressible material freely surrounding said bar and being subjected to compression between a second bearing (15) of the shank and a rigid cylinder (18) fixed to said bar, the means for regulating the elasticity of the said elastic sleeve being formed by a rigid sleeve (22**) surrounding the elastic sleeve and capable of being displaced along the elastic sleeve in a manner such as to modify the length of the elastic part situated outside the rigid sleeve and consequently capable of undergoing expansive deformation.

2. The boot as claimed in claim 1, wherein the tongue of the lock is attached to an eccentric operating lever (11) bearing on the outer face of the back of the shank of the boot, this operating lever pulling the tongue of the lock against the action of a restoring spring (13).

3. The boot as claimed in claim 1, wherein the means for driving the bar in rotation is formed by a knurled wheel (14), fixed to the shank for rotation.

* * * * *